US006412764B1

(12) United States Patent
Hebert

(10) Patent No.: US 6,412,764 B1
(45) Date of Patent: Jul. 2, 2002

(54) PORTABLE PIPE FITTING TABLE

(75) Inventor: Norbert A. Hebert, Burnt Hills, NY (US)

(73) Assignee: AJH Enterprises, Clifton Park, NY (US)

( * ) Notice: Subject to any disclaimer, the term of this patent is extended or adjusted under 35 U.S.C. 154(b) by 0 days.

(21) Appl. No.: 09/651,747

(22) Filed: Aug. 30, 2000

(51) Int. Cl.[7] ..... B25B 1/20

(52) U.S. Cl. ..... 269/45; 269/902; 269/58; 269/246

(58) Field of Search ..... 269/246, 43, 258, 269/DIG. 902, 287, 69, 93, 45, 902, 46, 58, 81, 909; 254/100, 133, DIG. 4

(56) References Cited

U.S. PATENT DOCUMENTS

| | | | | | |
|---|---|---|---|---|---|
| 1,701,242 | A | * | 2/1929 | Murdoch | 254/424 |
| 3,093,362 | A | * | 6/1963 | Schaefer | 254/424 |
| 3,973,765 | A | | 8/1976 | Babcock | |
| 4,265,283 | A | * | 5/1981 | Nash et al. | 144/286 R |
| 4,363,475 | A | | 12/1982 | McCarty | |
| 4,516,308 | A | * | 5/1985 | Urban | 29/564 |
| 4,595,186 | A | | 6/1986 | Reed et al. | |
| 4,898,238 | A | * | 2/1990 | Grantom | 166/75.1 |
| 5,157,870 | A | * | 10/1992 | Pike | 51/122 |
| 5,379,816 | A | * | 1/1995 | Charlton | 144/287 |
| 5,649,731 | A | * | 7/1997 | Tognetti | 296/26 |
| 5,709,256 | A | * | 1/1998 | Thormeier | 269/900 |
| 5,857,507 | A | * | 1/1999 | Puzio | 269/299 |
| 5,863,035 | A | | 1/1999 | Howell | |
| 5,887,878 | A | * | 3/1999 | Tisbo | 280/47.19 |
| 5,937,924 | A | * | 8/1999 | Cooper | 144/286.5 |
| 6,148,881 | A | * | 11/2000 | Valenzuela | 269/16 |
| 6,152,009 | A | * | 11/2000 | Jorgensen | 83/761 |
| 6,209,597 | B1 | * | 4/2001 | Calcote | 144/326 |

* cited by examiner

*Primary Examiner*—Joseph J. Hail, III
*Assistant Examiner*—Daniel Shanley
(74) *Attorney, Agent, or Firm*—Schmeiser, Olsen & Watts

(57) ABSTRACT

The present invention relates generally to a pipe fitting table used to temporally support a plurality of pipes being connected. More particularly, the present invention relates to providing welding, cutting and clamping devices on the pipe fitting table to assist an assembler in positioning and joining a plurality of pipes.

14 Claims, 7 Drawing Sheets

PORTABLE PIPE FITTING TABLE

FIELD OF THE INVENTION

The present invention relates generally to a pipe fitting table used to temporarily support a plurality of objects being interconnected. More particularly, the present invention relates to providing welding, cutting and clamping devices on the pipe fitting table to assist an assembler in positioning and joining a plurality of interconnected pipes.

BACKGROUND OF THE INVENTION

During construction of piping systems, the components (e.g., pipes, couplings, elbows, etc.) require clamping and positioning until they are permanently attached by (e.g., welding, soldering, glueing, etc.). An assembler typically uses clamps to hold and position the piping system components. It is difficult to accurately position-and hold the components in position. Thus, it is desirable to have a portable pipe fitting table that may assist the assembler in cutting, positioning, and clamping a plurality of components to form a piping system.

SUMMARY OF THE INVENTION

The present invention provides a portable pipe fitting table that includes cutting, positioning, and clamping devices that assists an assembler in accurately clamping and positioning the components in a piping system. Clamping devices included in the portable pipe fitting table hold the piping system components in position until the assembler can permanently attach the piping system components together to form a desired piping system.

BRIEF DESCRIPTION OF THE DRAWINGS

The features of the present invention will best be understood from a detailed description of the invention selected for the purposes of illustration and shown in the accompanying drawings in which.

DETAILED DESCRIPTION OF THE INVENTION

Figure 1:
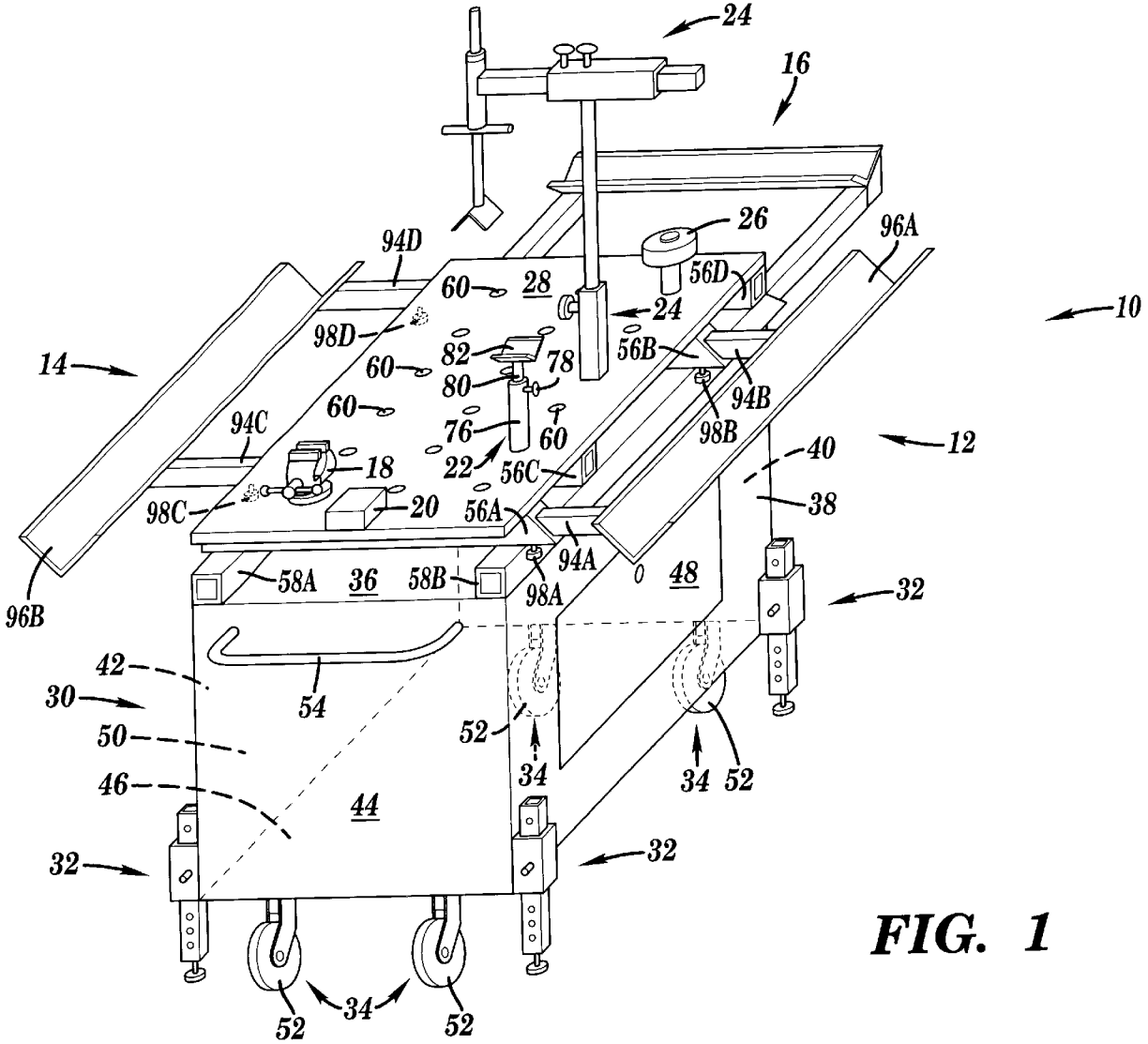
FIG. 1 illustrates a perspective view of a portable pipe fitting table.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., which are disclosed simply as an example of the embodiment. The features and advantages of the present invention are illustrated in detail in the accompanying drawings, wherein like reference numerals refer to like elements throughout the drawings. Although the drawings are intended to illustrate the present invention, the drawings are not necessarily drawn to scale.

Figure 2:
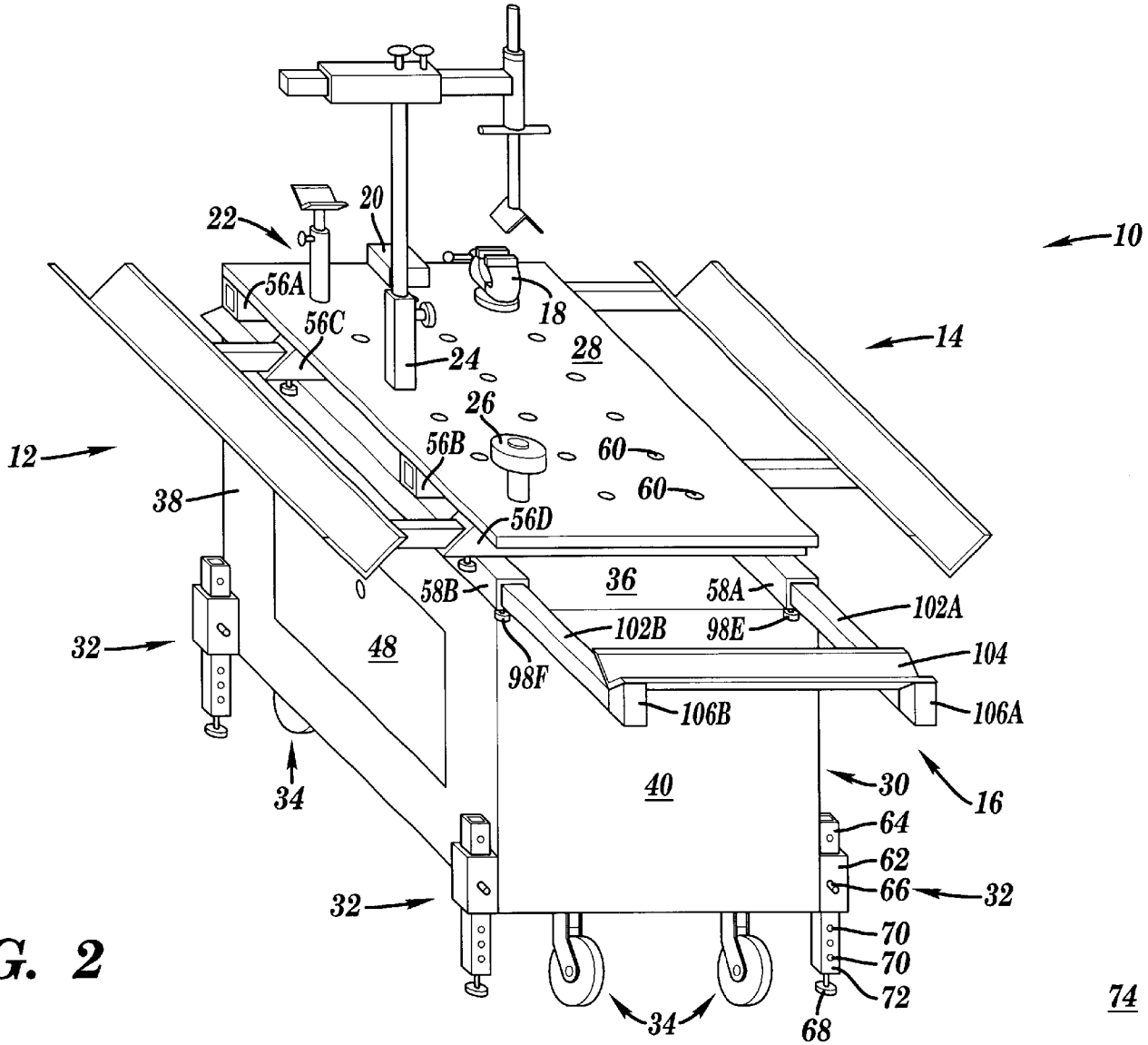
FIG. 2 illustrates another perspective view of the portable pipe fitting table.
Figure 3:
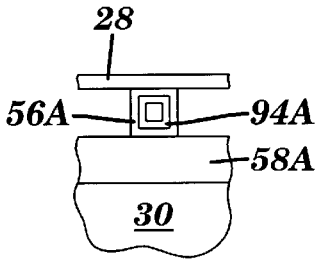
FIG. 3 illustrates an end view of a first extendable pipe support apparatus.

FIGS. 1 and 2 illustrate perspective views of a portable pipe fitting table 10. The portable pipe fitting table 10 includes a first extendable pipe support apparatus 12, a second extendable pipe support apparatus 14, a third extendable pipe support apparatus 16, a vise 18, a pipe cutting apparatus 20, a raised pipe support apparatus 22, a rotatable tower pipe clamp apparatus 24, a turntable apparatus 26, a top plate 28, a base assembly 30, a plurality of support leg assemblies 32, and a plurality of wheel assemblies 34.

The base assembly 30 includes a top side 36, a first side 38, a second side 40, a third side 42, a fourth side 44, and a bottom side 46. The first side 38 includes a door 48 that may be opened or closed to provide access to an interior storage space 50 within the base assembly 30. The interior storage space 50 may be used to hold any suitable items (e.g., tools, fittings, hardware, solder, etc.).

The plurality of wheel assemblies 34 are attached to the bottom side 46 of the base assembly 30. The wheel assemblies 34 include wheels 52 that allow the portable pipe fitting table 10 be easily moved from one location to another. The wheels 52 may be pivotally attached to the bottom side 46 of the base assembly 30. A handle 54 is attached to the fourth side 44 of the base assembly 30 (FIG. 1). The handle 54 allows an assembler to easily push, pull, or steer the rolling portable pipe fitting table 10.

The top plate 28 is attached to a transverse outer strut 56A, a transverse outer strut 56B, a transverse outer strut 56C, and a transverse outer strut 56D. The transverse outer struts 56A–56D are attached to the longitudinal outer struts 58A and 58B. The longitudinal outer struts 58A and 58B are attached to the top side 36 of the base assembly 30. The top plate 28 of the portable pipe fitting table 10 includes a plurality. of holes 60. The plurality of holes 60 may be used to attach any suitable item (e.g., raised pipe support apparatus 22, rotatable tower pipe clamp 24, turntable apparatus 26, etc.) to the top plate 28. Fasteners such as bolts, or threaded studs may pass through the holes 60 and may be secured to the top plate 28 using threaded nuts.

The base assembly 30 includes the plurality of support leg assemblies 32. Each support leg assembly 32 includes a leg holder 62, a leg 64, a pin 66, and a foot pad 68 (FIG. 2). The leg 64 includes a plurality of adjustment holes 70. The foot pad 68 is attached to a lower end 72 of the leg 64. The leg 64 slides through the leg holder 62. The pin 66 passes through the leg holder 62 and through one selected pair of adjustment holes 70. The leg 64 may be extended towards or retracted away from a floor surface 74. The leg 64 may be extended so that the foot pad 68 contacts the floor surface 74 such that the adjacent wheel 52 of the wheel assemblies 34 is removed from the floor surface 74. The portable pipe fitting table 10 may be solidly supported by each leg assembly 32 contacting the floor surface 74. This allows the portable pipe fitting table 10 to be stationary when the assembler is forming a pipe system. Each leg 64 of each leg assembly 32 may be retracted from the floor surface 74 allowing each wheel 52 of the wheel assemblies 34 to contact the floor surface 74. Then the portable pipe fitting table 10 may be rolled to another location.

As illustrated in FIG. 1, the vise 18 is attached to the top plate 28 of the portable pipe fitting table 10. The vise 18 may be attached using fasteners such as bolts and nuts passing through one or several of the holes 60. The assembler may use the vise to clamp piping components. The pipe cutting apparatus 20 is attached to the top plate 28 of the portable pipe fitting table 10. The pipe cutting apparatus 20 may include any suitable device used for cutting a pipe section into a desired length.

As illustrated in FIG. 1, the raised pipe support apparatus 22 includes a base upright 76, a locking screw 78, a shaft 80 and an angle member 82. The base upright 76 may be removably attached to the top plate 28 of the portable pipe fitting table 10. The base upright 76 may be attached by a fastener passing through one of the holes 60 in the top plate 28. The angle member 82 is attached to the shaft 80. The shaft 80 slides within the base upright 76 and is locked into a vertical position by the locking screw 78. The assembler may use the angle member 82 to support a portion of piping. The angle member 82 may be raised or lowered by extending or retracting the shaft 80 within the base upright 76. The assembler locks the angle member 82 in a desired position by turning the locking screw 78.

Figure 10:
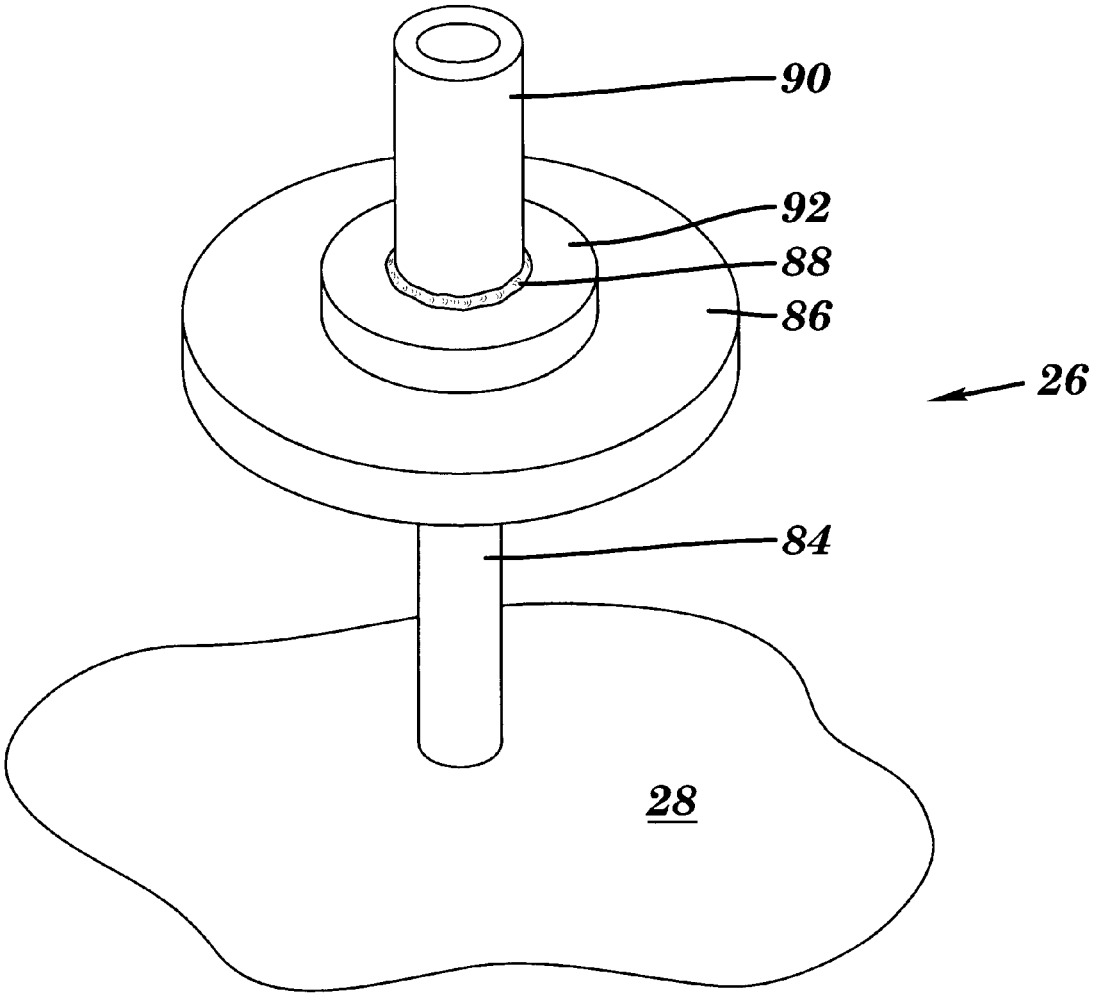
FIG. 10 illustrates a perspective view of a turntable supporting a pipe element being welded to a plate element.

The turntable apparatus 26 is removably attached to the top plate 28 using a fastener passing through one of the holes 60. As illustrated in FIG. 10, the turntable appartus 26 includes an upright support shaft 84, and a disc 86. The disc 86 is rotatably attached to the upright support shaft 84. The turntable apparatus 26 may be used by the assembler to weld around a peripheral edge 88 of a pipe member 90. For example, in FIG. 10, the pipe member 90 is being welded to a plate member 92. The plate member 92 is clamped to the disc 86 of the turntable apparatus 26 by any suitable means such as a clamp (not shown). The assembler rotates the disc 86 while welding at the peripheral edge 88 of the pipe member 90 to the plate member 92. The rotating disc 86 rotates the plate member 92 and the pipe member 90. This allows the assembler to hold the welding element at one location while the peripheral edge 88 of the pipe member 90 travels past the welding element. Thus, a welded joint is formed along the peripheral edge 88 of the pipe member 90.

Figure 4:
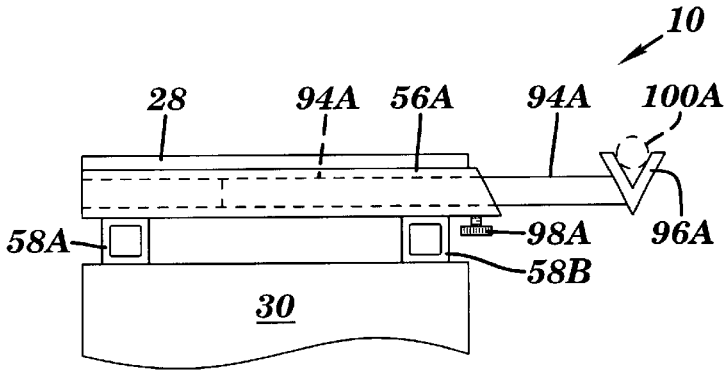
FIG. 4 illustrates a side view of the first extendable pipe support apparatus with a first v-support extended.
Figure 5:
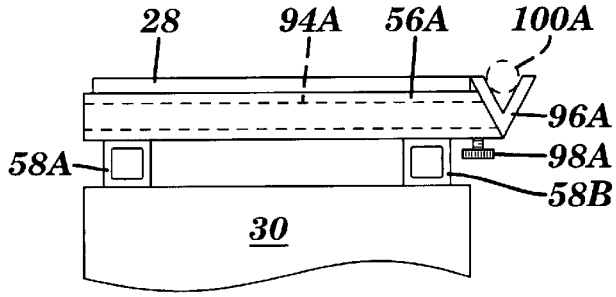
FIG. 5 illustrates a side view of the first extendable pipe support apparatus with the first v-support retracted.

As illustrated in FIGS. 1–4, the first extendable pipe support apparatus 12 includes the transverse outer strut 56A, the transverse outer strut 56B, a transverse inner strut 94A, a transverse inner strut 94B, a first v-support 96A, a locking screw 98A, and a locking screw 98B (FIG. 1). The transverse inner struts 94A and 94B slide within the transverse outer struts 56A and 56B, respectively. The first v-support 96A is rigidly attached to the transverse inner struts 94A and 94B. The locking screws 98A and 98B may be tightened or loosened by the assembler to lock or release the transverse inner struts 94A and 94B from the transverse outer struts 56A and 56B, respectively. FIG. 4 illustrates the first v-support 96A extended away from the top plate 28 of the portable pipe fitting table 10. FIG. 5 illustrates the first v-support 96A in a retracted position, whereby the first v-support 96A is resting against the top plate 28. The first v-support 96A may support a pipe member 100A as shown in phantom in FIGS. 4 and 5. The first extendable pipe support apparatus 12 may support the pipe member 100A and may position the pipe member 100A closer or farther away from the top plate 28. In a similar manner, the second pipe support apparatus 14 includes the transverse outer strut 56C, the transverse outer strut 56D, a transverse inner strut 94C, a transverse inner strut 94D, a second v-support 96B, a locking screw 98C, and a locking screw 98D (FIG. 1). The second pipe support apparatus 14 allows the second v-support 96B to be extended away from the top plate 28 or retracted towards the top plate 28.

Figure 6:
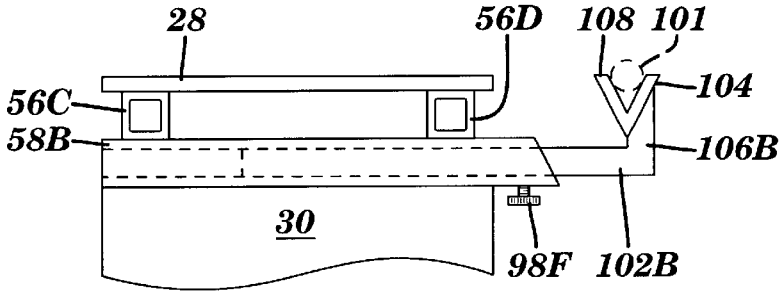
FIG. 6 illustrates a side view of a third extendable pipe support apparatus with a third v-support extended.
Figure 7:
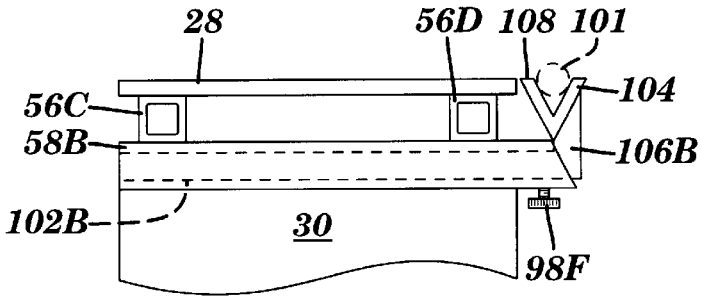
FIG. 7 illustrates a side view of the third extendable pipe support apparatus with the third v-support retracted.

FIGS. 2, 6 and 7 illustrates the third extendable pipe support apparatus 16. The third extendable pipe support apparatus 16 includes the longitudinal outer strut 58A, the longitudinal outer strut 58B, a longitudinal inner strut 102A, a longitudinal inner strut 102B, a third v-support 104, a locking screw 98E, and a locking screw 98F (FIG. 2). The longitudinal inner struts 102A and 102B slide within the longitudinal outer struts 58A and 58B, respectively. The third v-support 104 is rigidly attached to the longitudinal inner struts 102A and 102B. The locking screws 98E and 98F may be tightened or loosened by the assembler to lock or release the longitudinal inner struts 102A and 102B from the outer longitudinal struts 58A and 58B, respectively. The longitudinal inner struts 102A and 102B include upright portions 106A and 106B to raise and align an upper portion 108 of the third v-support to be aligned with the top-plate 28. FIG. 6 illustrates the third v-support 104 extended away from the top plate 28 of the portable pipe fitting table 10. FIG. 7 illustrates the third v-support 104 in a retracted position whereby the third v-support 104 is resting against the top plate 28. The third extendable pipe support apparatus 16 may support a pipe member 101 as shown in phantom in FIGS. 6 and 7.

Figure 8:
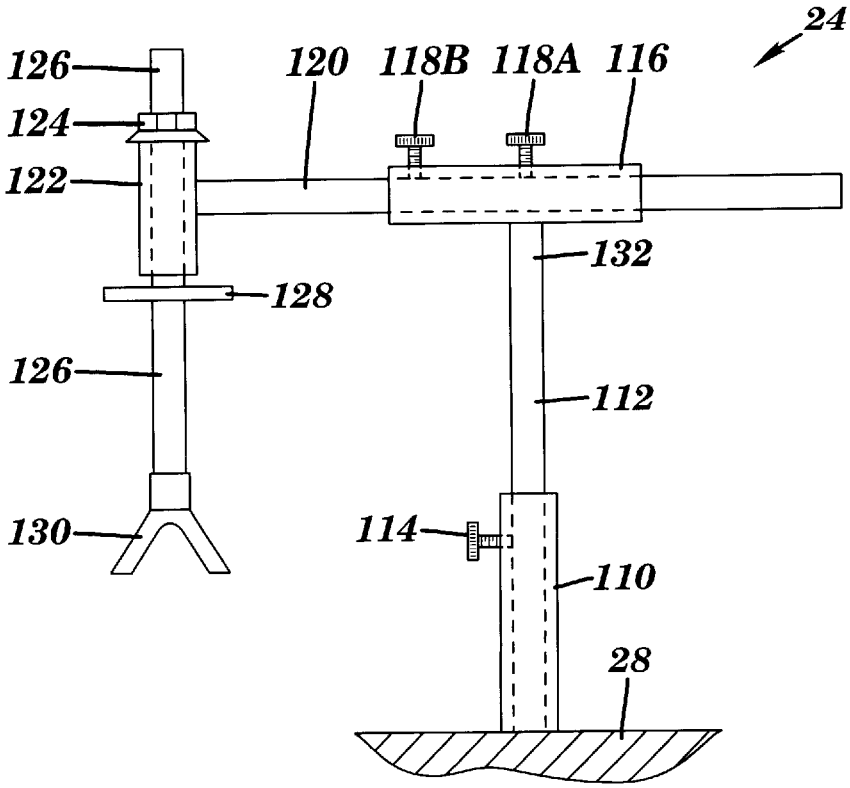
FIG. 8 illustrates a side view of a rotatable tower clamping apparatus.

FIGS. 1, 2, and 8 illustrate the rotatable tower pipe clamp apparatus 24. The rotatable tower pipe clamp apparatus 24 includes a base 110, a shaft 112, a locking screw 114, a beam support 116, a locking screw 118A, a locking screw 118B, a beam 120, a collar 122, a nut 124, a height adjustment rod 126, a handle 128, and an angle block 130 (FIG. 8). The base 110 is removably attached to the top plate 28. The shaft 112 slides vertically upward and downward within the base 110. The locking screw 114 may be tightened to lock the shaft 112 in a selected vertical position. Additionally, the shaft 112 provides rotation of the rotatable tower pipe clamp apparatus 24 about the base 110. An upper portion 132 of the shaft 112 is rigidly attached to the beam support 116. The beam 120 slides in a horizontal direction within the beam support 116. The locking screws 118A and 118B may be tightened to lock the beam 120 in a selected horizontal position. The collar 122 is rigidly attached to the beam 120. The height adjustment rod 126 slides within the collar 122 and is locked in a vertical position by the nut 124. The handle 128 is attached to the height adjustment rod 126 and allows the assembler to easily-rotate and vertically adjust the height adjustment rod 126. The angle block 130 is attached to the height adjustment rod 126. Thus, the angle block 130 may be positionally rotated and raised or lowered upon or away from a selected object.

Figure 9:
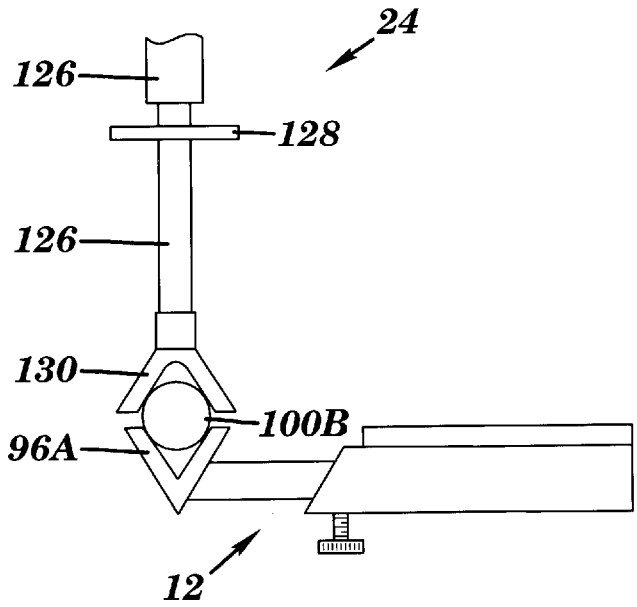
FIG. 9 illustrates a side view of an angle block of the rotatable tower clamping apparatus pressing against a pipe and a second v-support of a second pipe support apparatus.

For example, FIG. 9 illustrates the rotatable tower pipe clamp apparatus 24 being used to clamp an object, such as a pipe member 100B, onto the first v-support 96A of the first extendable pipe support apparatus 12. The angle block 130 has been rotatably and vertically positioned above the pipe member 100B. The rotatable tower pipe clamp apparatus 24 provides a downward clamping force upon the pipe member 100B. The pipe member 100B is held between the first v-support 96A and the angle block 130 of the rotatable tower pipe clamp apparatus 24.

Figure 11:
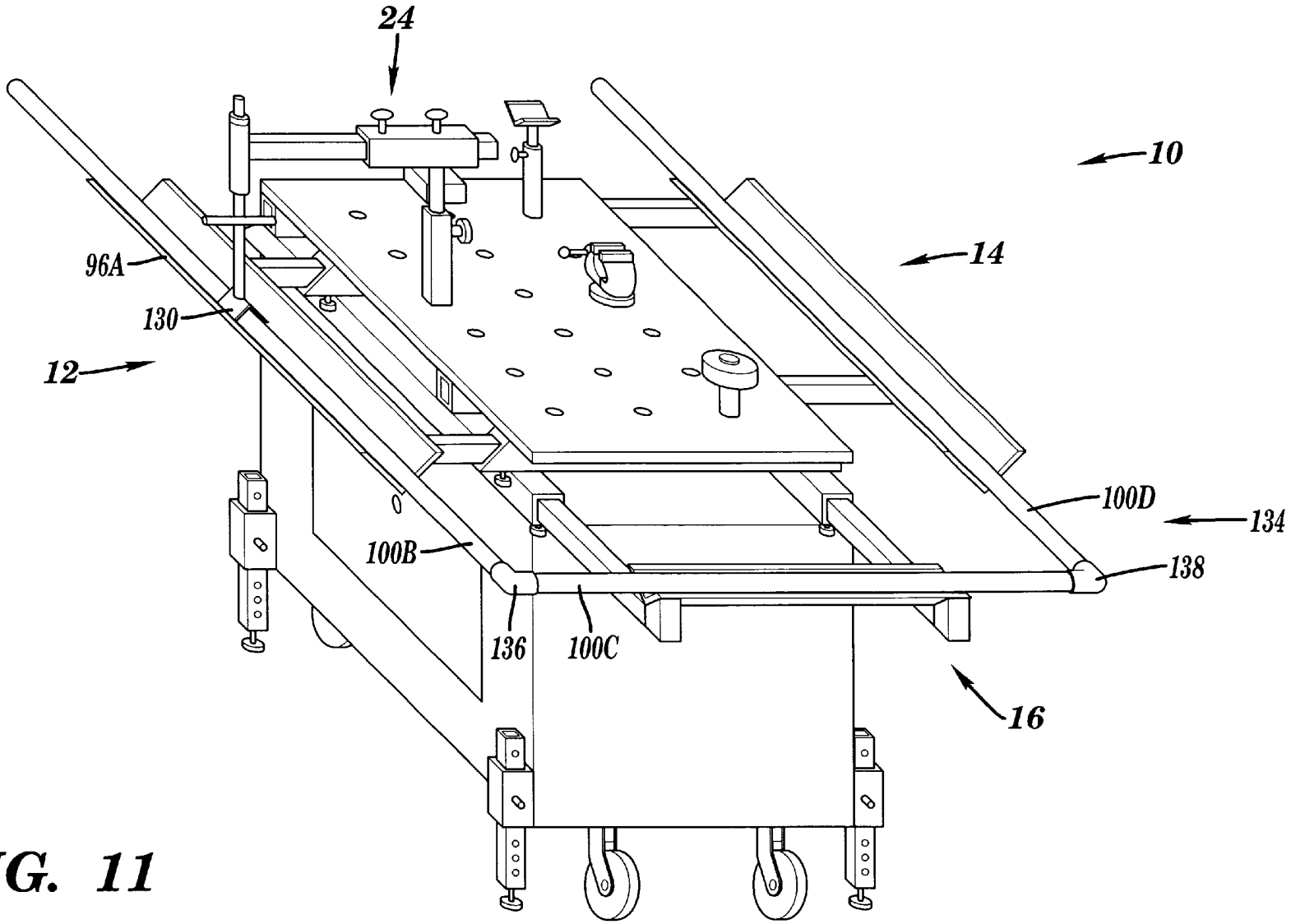
FIG. 11 illustrates a perspective view of a first pipe system being supported by the first, second, and third extendable pipe support apparatus.

FIG. 11 illustrates the portable pipe fitting table 10 being used to position and hold a series of interconnected pipes 134. The series of interconnected pipes 134 includes the pipe member 100B, an elbow 136, a pipe member 100C, an elbow 138, and a pipe member 100D. The second extendable pipe support apparatus 14 has been positioned to support the pipe member 100D. The third extendable pipe support apparatus 16 has been positioned to support the pipe member 100C. The first extendable pipe support apparatus 12 has been positioned to support the pipe member 100B. The angle block 130 of the rotatable tower pipe clamp apparatus 24 has been rotated into position to provide a downward clamping force against the pipe member 100B within the first v-support 96A of the first extendable pipe support apparatus 12. The assembler then welds the elbow 136 to the pipe members 100B and 100C. Then the assembler welds the elbow 138 to the pipe members 100C and 100D. Thus, a rigid series of interconnected pipes 134 is created.

Figure 12:
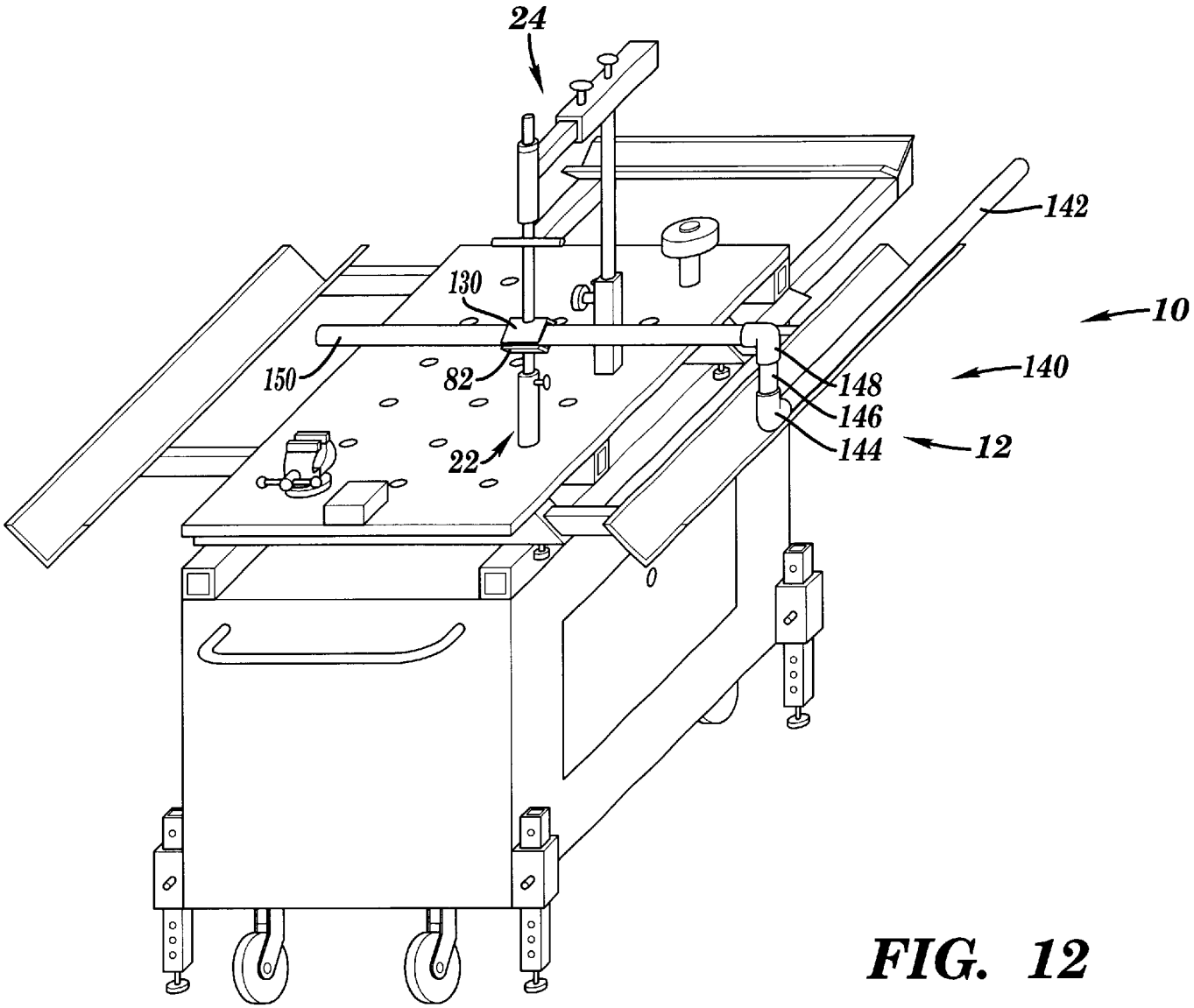
FIG. 12 illustrates a perspective view of a second pipe system being supported by the first extendable pipe support apparatus and by a raised pipe support.

FIG. 12 illustrates the portable pipe fitting table 10 being used to position and hold another series of interconnected pipes 140. The series of interconnected 20 pipes 140 includes a pipe member 142, an elbow 144, a pipe member 146, an elbow 148, and a pipe member 150. The first extendable pipe support apparatus 12 has been positioned to support the pipe member 142 and the elbow 144. The raised pipe support apparatus 22 has been positioned to support the pipe member 150 with the angle member 82. The rotatable tower pipe support apparatus 24 has been positioned so that the angle block 130 is positioned above the pipe member 150 and the angle member 82. The angle block 130 provides a downward clamping force upon the pipe member 150. The assembler then welds the elbow 148 to the pipe members 150 and 146. Then the assembler welds the elbow 146 to the pipe members 146 and 142. Thus, a rigid series of interconnected pipes 140 is created.

The foregoing description of the present invention has been presented for purposes of illustration and description. It is not intended to be exhaustive or to limit the invention to the precise form disclosed, and many modifications and variations are possible in light of the above teaching. For example, the portable pipe fitting table 10 may be used to support and position a plurality of any suitable objects (e.g., pipes, conduit, tubing, structural angles, etc.). The objects may be joined together by any suitable means (e.g., welding, soldering, glueing, etc.). Such modifications and variations that may be apparent to a person skilled in the art are intended to be included within the scope of this invention as defined by the accompanying claims.

I claim:

1. An apparatus, comprising:

a base;

a top plate attached to the base; and a plurality of extendable and retractable support pipe members slidingly attached to the base, for supporting at least one component of a pipe system.

2. The apparatus of claim 1, wherein the base includes a plurality of sides enclosing a space.

3. The apparatus of claim 2, further including a door on the base to gain access to the space.

4. The apparatus of claim 1, further including a plurality of holes in the top plate for attaching a plurality of support elements onto the top plate.

5. The apparatus of claim 1, further including wheels attached to the base.

6. The apparatus of claim 5, further including a handle attached to the base for pushing or pulling the base.

7. The apparatus of claim 6, further including a plurality of height adjustable legs to contact a floor.

8. The apparatus of claim 1, further including a vise attached to the top plate for clamping at least one component of the pipe system.

9. The apparatus of claim 1, further including a cutter attached to the top plate for cutting at least one component of the pipe system.

10. The apparatus of claim 1, further including a turntable attached to the top plate for providing rotation of at least one component of the pipe system.

11. The apparatus of claim 1, further including a raised support attached to the top plate for supporting at least one component of the pipe system above the top plate.

12. The apparatus of claim 1, further including a rotatable tower clamp for providing downward clamping pressure onto at least one component of the pipe system.

13. The apparatus of claim 1, wherein each extendable and retractable support member includes a v-support for supporting at least one component of the pipe system.

14. The apparatus of claim 1, wherein each extendable and retractable support member includes a locking screw to secure the extendable and retractable support member in a selected position.

* * * * *